US007963744B2

(12) United States Patent
North

(10) Patent No.: US 7,963,744 B2
(45) Date of Patent: Jun. 21, 2011

(54) COOLING OF PUMP ROTORS

(75) Inventor: Michael Henry North, Redhill (GB)

(73) Assignee: Edwards Limited, Crawley, West Sussex (GB)

( * ) Notice: Subject to any disclaimer, the term of this patent is extended or adjusted under 35 U.S.C. 154(b) by 1083 days.

(21) Appl. No.: 11/661,490

(22) PCT Filed: Aug. 17, 2005

(86) PCT No.: PCT/GB2005/003225

§ 371 (c)(1),
(2), (4) Date: Feb. 27, 2007

(87) PCT Pub. No.: WO2006/024818

PCT Pub. Date: Mar. 9, 2006

(65) Prior Publication Data

US 2008/0031761 A1 Feb. 7, 2008

(30) Foreign Application Priority Data

Sep. 2, 2004 (GB) ..... 0419514.5
Oct. 6, 2004 (GB) ..... 0422195.8

(51) Int. Cl.
*F04D 29/58* (2006.01)
*F04C 29/04* (2006.01)
*F04C 18/16* (2006.01)

(52) U.S. Cl. ..... 416/96 R; 415/72; 415/90; 415/115; 418/85; 418/88; 418/92; 418/94; 418/206.3

(58) Field of Classification Search ..... 415/90, 415/143, 115, 116, 72–74; 416/95, 96 R, 416/96 A; 417/423.4; 418/85, 88, 91, 92, 418/94, 206.3
See application file for complete search history.

(56) References Cited

U.S. PATENT DOCUMENTS 2,873,909 A 2/1959 Nilsson
5,662,463 A 9/1997 Mirzoev et al.
(Continued)

FOREIGN PATENT DOCUMENTS

DE 19817351 A1 * 10/1999
(Continued)

OTHER PUBLICATIONS

Peter Frieden, Abstract of DE 19817351, "Screw Spindle Vacuum Pump with Gas Cooling," Oct. 21, 1999.

(Continued)

*Primary Examiner* — Christopher Verdier

(57) ABSTRACT

A rotor for a screw vacuum pump has a threaded body in which a central cavity is formed. A coolant is supplied to the cavity from a supply line provided in a shaft attached to the body. A coolant flow guide, which may be either separate from or at least partially integral with the shaft, is located within the cavity. The flow guide has an outer surface adjacent, preferably in contact with, the body to enable heat to the transferred from the rotor to the guide. The guide also has an inner surface defining a bore, and defines at least in part a plurality of axially extending slots radially spaced from and in fluid communication with the bore. In use, coolant flows into the cavity through the bore of the guide, and out from the cavity through the axially extending slots, extracting heat from the guide as it flows both into and out form the cavity. The discharged coolant is conveyed form the slots into a discharge line located within the shaft.

18 Claims, 6 Drawing Sheets

U.S. PATENT DOCUMENTS

| | | | | |
|---|---|---|---|---|
| 6,382,930 | B1 | 5/2002 | Bahnen et al. | |
| 2004/0091380 | A1 * | 5/2004 | Kriehn et al. | 418/179 |
| 2005/0069446 | A1 * | 3/2005 | Kriehn | 418/94 |

FOREIGN PATENT DOCUMENTS

| | | | |
|---|---|---|---|
| DE | 19963171 | A1 * | 6/2001 |
| FR | 1 360 938 | | 5/1964 |
| FR | 2 084 314 | | 12/1971 |
| GB | 467 022 | | 6/1937 |
| WO | WO 95/02767 | A1 | 1/1995 |
| WO | WO 02/12726 | A1 | 2/2002 |
| WO | WO 2004/036049 | A1 | 4/2004 |

OTHER PUBLICATIONS

Kriehn Hartmut, Abstract of DE 19963171 A, "Screw-type Vacuum Pump Used in Cooling Circuits has Guide Components Located in Open Bores in Shafts Serving for Separate Guiding of Inflowing and Outflowing Cooling Medium," Leybold Vakuum GmbH, Jun. 28, 2001.

United Kingdom Search Report of Application No. GB 0422195.8; Claims searched: 1-22; Date of search: Dec. 14, 2004.

PCT Notification of Transmittal of the International Search Report and the Written Opinion of the International Searching Authority, or the Declaration of International Application No. PCT/GB2005/003225; Date of mailing: Oct. 10, 2005.

PCT International Search Report of International Application No. PCT/GB2005/003225; Date of mailing of the International Search Report: Oct. 10, 2005.

PCT Written Opinion of the International Searching Authority of International Application No. PCT/GB2005/003225; Date of mailing: Oct. 10, 2005.

* cited by examiner

COOLING OF PUMP ROTORS

FIELD OF THE INVENTION

The present invention relates to the cooling of pump rotors, and in particular to the cooling of the rotors of a screw pump.

BACKGROUND OF THE INVENTION

Screw pumps are widely used in industrial processes to provide a clean and/or low pressure environment for the manufacture of products. Applications include the pharmaceutical and semiconductor manufacturing industries. A typical screw pump mechanism comprises two spaced parallel shafts each carrying externally threaded rotors, the shafts being mounted in a pump body such that the threads of the rotors intermesh. Close tolerances between the rotor threads at the points of intermeshing and with the internal surface of the pump body (which acts as a stator) cause volumes of gas entering at an inlet to be trapped between the threads of the rotors and the internal surface and thereby urged towards an outlet of the pump as the rotors rotate.

During use, heat is generated as a result of the compression of the gas by the rotors acting in combination with one another. Consequently, the temperature of the rotors rapidly rises. By comparison, the bulk of the stator is large and heating thereof is somewhat slower. This produces a disparity in temperature between the rotors and the stator which, if allowed to build up unabated, could result in the rotors seizing within the stator as the clearance therebetween is reduced. Therefore, it is desirable to provide a system for cooling the rotors.

FIG. 1 illustrates schematically one known arrangement for cooling an outlet section of a double-ended rotor of a screw pump, as illustrated in our earlier International patent application no. WO 2004/036049, the contents of which are incorporated herein by reference. In this arrangement, a central cavity 10 is formed in each end of the threaded body 12 of the rotor (one end only shown in FIG. 1), the cavity 10 being co-axial with the body 12, the longitudinal axis of which is indicated at 14. A shaft 16 is attached to the body 12 by means of bolts 18 such that the shaft 16 extends into the cavity 10 and rotates with the body 12 of the rotor during use. The shaft 16 has a first central bore 20 formed therein. The first bore 20 houses a coolant supply tube 22 for supplying coolant pumped from a source thereof into a second central bore 24 of the shaft 16, the second bore 24 being co-axial with the first bore 20. The coolant flows from the second bore 24 into the cavity 10, wherein the coolant flows radially outwards between the end 26 of the shaft 16 and the end wall 28 of the cavity 10, and then flows away from the end wall 28 within a narrow annular gap 30 located between the cylindrical wall 32 of the shaft 16 and the cylindrical wall 34 of the cavity 10. Radial bores 36 formed in the shaft 16 allow the coolant to flow into the first bore 20 of the shaft 16 and back towards the end 38 of the shaft 16, from which it is discharged into a reservoir (not shown) with a pumping mechanism for returning the coolant to the supply tube 22.

It is an aim of at least the preferred embodiment of the invention to provide an improved arrangement for cooling the rotor of a screw pump.

SUMMARY OF THE INVENTION

In a first aspect, the present invention provides a rotor for a vacuum pump, the rotor comprising a threaded body, a cavity extending axially into the body, means for supplying a coolant to the cavity, means for discharging coolant from the cavity, and means located within the cavity for guiding a coolant flow between the supply means and the discharge means, wherein the guiding means has an inner surface defining a bore and an outer surface located adjacent the body to enable heat to be transferred thereto from the body, and defines at least in part a plurality of slots extending along the guiding means, the slots being radially spaced from and in fluid communication with the bore.

In the prior art, the heated surface of the rotor that is exposed for cooling by the coolant is limited to the surface area of the cylindrical wall 34 of the cavity 10. In order to increase the surface area exposed for cooling, the present invention dispenses with the annular gap 30 of the prior art and instead provides a flow guide that is closely adjacent, preferably in contact with, the body and which defines within the cavity a bore and a plurality of slots extending along the flow guide and radially spaced from the bore. By virtue of the close proximity, typically less than 0.1 mm, of the flow guide to the rotor body, heat can be transferred from the rotor body into the flow guide. The flow guide may be located adjacent the rotor body so that, in use, thermal expansion of the flow guide causes the flow guide to contact the body. The heated surface now exposed for cooling includes both the surface area of the inner surface of the guide, which defines the bore, and the sum of the surface areas of the walls of the slots, so that heat can be extracted from the rotor by coolant as it flows both into the rotor and out from the rotor. This can significantly increase the surface area for cooling in comparison to a prior art arrangement having a similar sized cavity formed in the rotor body.

The guiding means is preferably formed from different material than the rotor body. In order to maximise the cooling of the rotor, at least part of the guiding means is preferably formed from material having a thermal conductivity equal to or greater than that of the material from which the rotor body is formed. For example, when the rotor body is formed from iron, the guiding means is preferably formed from aluminum or an alloy thereof, copper or an alloy thereof, or any other suitable material having a thermal conductivity equal to or greater than that of iron.

In a second aspect, the present invention provides a rotor for a vacuum pump, the rotor comprising a threaded body having, at each end thereof, a cavity extending thereinto, means for supplying a coolant to each cavity, and means for discharging coolant from each cavity, each cavity having located therein means for guiding a coolant flow between the supply means and the discharge means, wherein the guiding means has an inner surface defining a bore and an outer surface located adjacent the body to enable heat to be transferred thereto from the body, and defines at least in part a plurality of slots extending along the guiding means, the slots being radially spaced from and in fluid communication with the bore.

In another aspect, the present invention provides a rotor for a vacuum pump, the rotor comprising a threaded body having a plurality of axial cavities extending partially thereinto and located about the longitudinal axis of the rotor, means for supplying a coolant to each cavity, means for guiding a flow of coolant within each cavity, and means for discharging coolant from each cavity. This aspect of the invention dispenses with the central cavity 10 of the prior art, and instead provides a plurality of cavities, preferably provided by a plurality of bores partially formed in the threaded body of the rotor, which are located about the longitudinal axis of the rotor. With such an arrangement, the surface area of coolant in contact with the body of the rotor at any given time can be significantly increased in comparison to the prior arrangement where a single, central cavity is used. Therefore, in a further aspect the present invention provides a rotor for a vacuum pump, the rotor comprising a threaded body having, at each end thereof, a plurality of cavities extending axially thereinto and located about the longitudinal axis of the rotor, means for supplying a coolant to each cavity, and means for discharging coolant from each cavity, each cavity having located therein means for guiding a coolant flow into and out from the cavity.

The guide means preferably defines within each cavity a coolant flow path extending between the supply means and the discharge means. The coolant flow path preferably has a first portion along which coolant flows in a first direction and a second portion along which coolant flows in a second direction opposite to the first. The guide means preferably comprises, within each cavity, a tube for defining the first and second portions of the flow path. The first portion of the flow path may extend between the body and the outer wall of the tube, and the second portion of the flow path may extend within the bore of the tube. Each tube preferably comprises one or more radial bores for linking the first portion of the flow path to the second portion of the flow. The supply means is preferably arranged to supply coolant to the first portion of the flow path, and the discharge-means is preferably arranged to receive coolant from the second portion of the flow path.

BRIEF DESCRIPTION OF THE DRAWINGS

Preferred features of the present invention will now be described with reference to the accompanying drawings, in which:

FIG. 3(*b*) is a sectional view taken along line A-A of FIG. 3(*a*);

DETAILED DESCRIPTION OF THE INVENTION

Figure 2A:
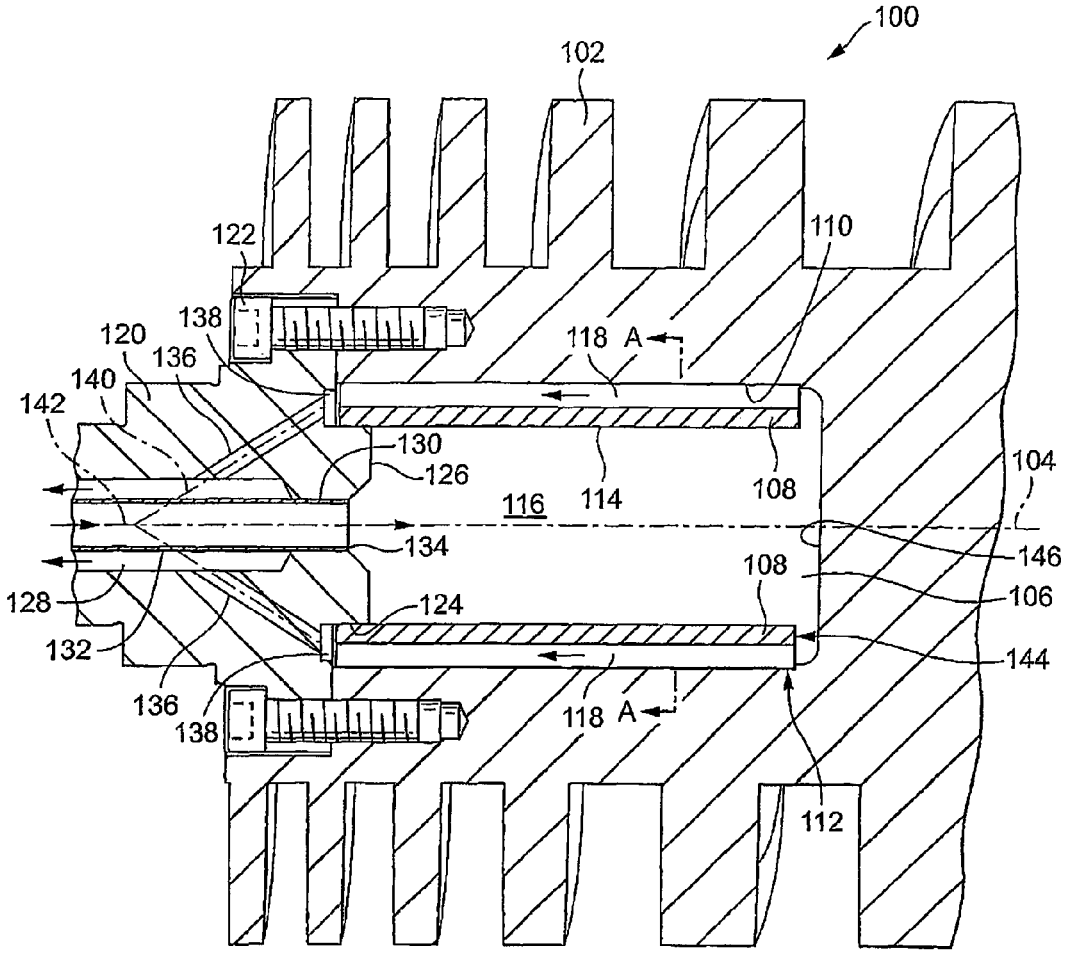
FIG. 2(*a*) is a cross-section through part of a first embodiment of a rotor of a screw pump, and FIG. 2(*b*) is a section along line A-A of FIG. 2(*a*)
Figure 2B:
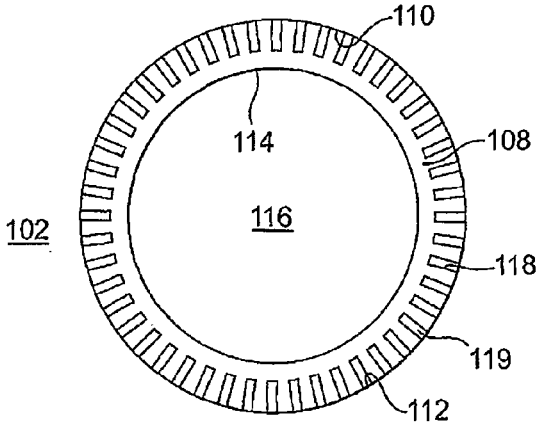

FIG. 2 illustrates part of a first embodiment of a rotor 100 of a screw pump. The rotor 100 comprises a threaded body 102 having a longitudinal axis 104. A cavity 106 is formed in the body 102 such that the cavity 106 extends partially into and is substantially co-axial with the body 102.

A tube 108 is located within the cavity 106, co-axial with the body 102, such that the outer surface 110 of the tube 108 forms an interference fit with the cylindrical wall 112 of the cavity 106. The tube 108 may be inserted in the cavity 106 using any convenient technique, such as shrink fitting in which the tube 108 is initially shrunk using liquid nitrogen, for example, and inserted into the cavity 106 so that subsequent thermal expansion causes the tube 108 to be rigidly located within the cavity 106.

The tube 108 is preferably formed, at least in part, from material that has a thermal conductivity that is at least equal to that of the material from which the body 102 is formed. In the preferred embodiment, the body 102 is formed from iron, and the tube 108 is formed from an aluminum alloy.

As shown in FIG. 2(*b*), the inner, cylindrical surface 114 of the tube 108 defines a bore 116 extending into the cavity 106 substantially co-axial with the body 102. A plurality of grooves 118 are machined or otherwise formed on the outer surface 110 of the tube 108, each groove 118 extending along the length of the tube 108. In the preferred embodiment, each groove 118 extends substantially parallel to the longitudinal axis 104 of the body, although part of the each groove 118 may be curved or otherwise shaped as required. The grooves 118 define with the wall 112 of the cavity a plurality of axially extending slots 119 surrounding the bore 116 of the tube 108. As shown in FIG. 2(*a*), the tube 108 is not inserted fully into the cavity 106 so that the slots 119 are in fluid communication with the bore 116.

A shaft 120 extends partially into the bore 116 of the tube 108, and is attached to the body 102 by means of bolts 122 or the like. As indicated in FIG. 2(*a*), the shaft 120 is co-axial with the body 102. The shaft 120 is machined such that a cylindrical outer surface 124 of the end 126 of the shaft 120 that extends into the bore 116 engages the inner surface 114 of the tube 108.

The shaft 120 includes a longitudinal bore 128 that passes along the length of the shaft 120 and is co-axial therewith. The longitudinal bore 128 has a constant diameter along the majority of the shaft 120, the diameter reducing towards the end 126 of the shaft 120 to define a reduced-diameter section 130 of the longitudinal bore 128. A coolant supply tube 132 is located within the longitudinal bore 128. The coolant supply tube 132 has an outer diameter that is slightly less than that of the reduced-diameter section 130 of the longitudinal bore 128. The coolant supply tube 132 extends through the longitudinal bore 128 such that a first end 134 is located within the bore 116 and a second end thereof (not shown) extends from the other end (not shown) of the shaft 120. The second end of the coolant supply tube may be retained by any convenient means. To inhibit rotation of the coolant supply tube 132 within the longitudinal bore 128 with rotation of the rotor 100, a plain bearing is provided between the reduced-diameter section 130 of the longitudinal bore 128 and the coolant supply tube 132.

The shaft 120 further includes a plurality of second bores 136, each extending between the longitudinal bore 128 and an annular recess or channel 138 formed in the shaft 102 and radially aligned with the slots 119. The longitudinal axis 140 of each second bore 136 is at an acute angle to the longitudinal axis 104 of the rotor 100. In this example, this acute angle is approximately 30°, although any convenient value for this angle may be chosen.

In use, a stream of coolant, for example a coolant oil, is supplied from a source thereof to the second end of the coolant supply tube 132. The source may be conveniently provided by an oil reservoir located external to the stator of the pump in which the rotor is housed. The coolant flows through the bore 142 of the coolant supply tube 132 and into the bore 116 of the tube 108. The coolant passes along the bore 116, and at the end wall 146 of the cavity 106 flows radially outwards between the end 144 of the tube 108 and the end wall 146 of the cavity 106 and enters the slots 119 defined between the tube 108 and the body 102, within which it flows back towards the shaft 120, that is, in a direction opposite to the direction of the coolant flow through the bore 116. From the slots 119 the coolant enters the annular recess 138, from which it is conveyed into the second bores 136, which convey the coolant into the bore 128 of the shaft 120. The coolant passes within the bore 128 along the outside of the coolant supply tube 132 and is exhaust back into the oil reservoir, from which the coolant may be pumped back to the second end of the shaft 120 via a suitable heat exchange mechanism. The arrows in FIG. 2(*a*) indicate the direction of the coolant flow through the illustrated part of the rotor 100.

The tube 108 inserted in the cavity 106 thus provides a guide for guiding the flow of coolant within the cavity that is, unlike the shaft 16 of the prior art, in contact with the body 102. By virtue of the contact between the tube 108 and the rotor body 102, heat can be conducted from the rotor body 102 into the tube 108. The heated surface exposed to the coolant therefore includes both the inner surface 114 of the tube 108, and the sum of the surface areas of the walls of the slots 119, so that heat can be extracted from the rotor 100 by coolant flowing both into and out from the rotor 100. This enhances the cooling of the rotor 100 and thus enables the cold radial clearance between the rotor and the stator to be reduced, thereby providing an improvement to the pumping efficiency.

Figure 3A:
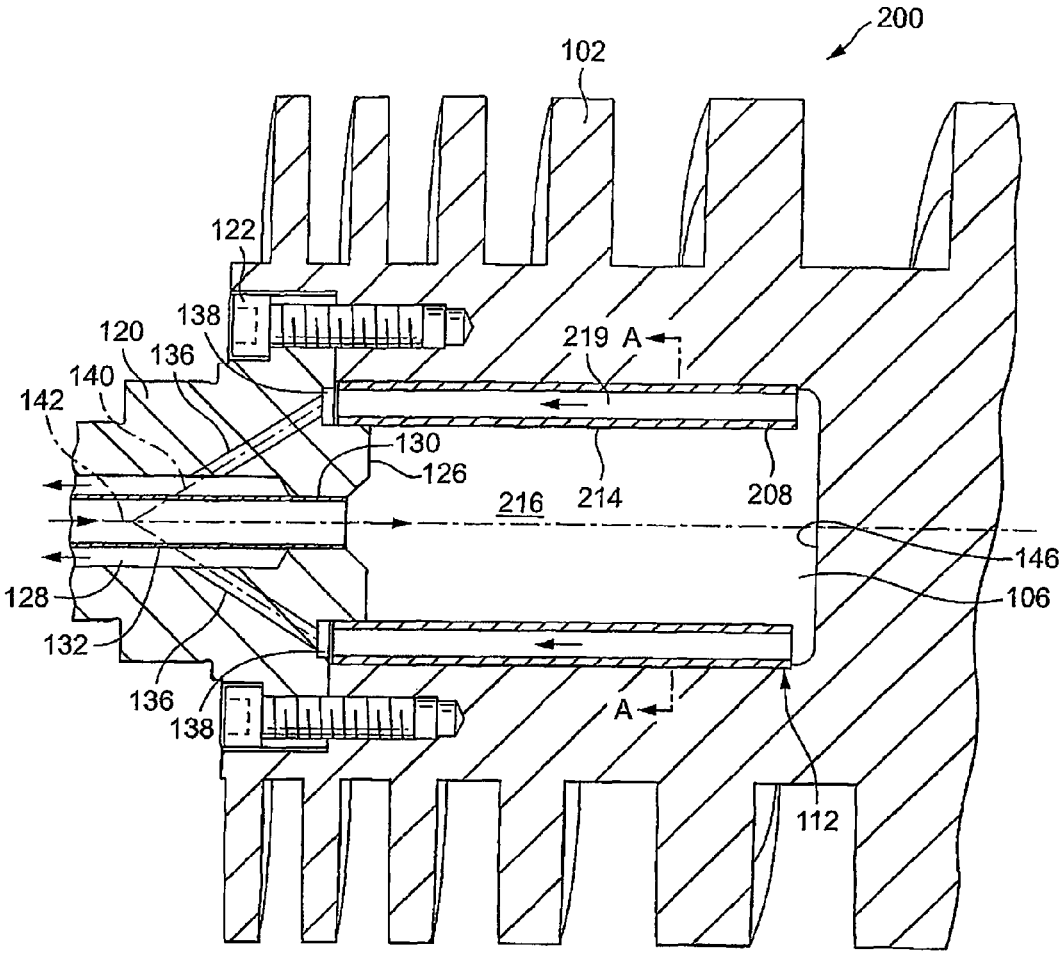
FIG. 3(*a*) is a cross-section through part of a second embodiment of a rotor of a screw pump.
Figure 3B:
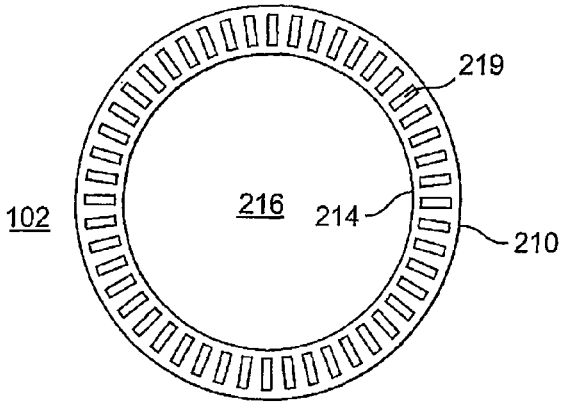

FIG. 3 illustrates part of a second embodiment of a rotor 200 of a screw pump, and in which features identical to those of the first embodiment shown in FIG. 2 have been given the same reference numerals. In this second embodiment, the tube 108 of the first embodiment is replaced by a tube 208, formed from similar material to the tube 108 and which similarly forms an interference fit with the cylindrical wall 112 of the cavity 106. This tube 208 also has an inner surface 214 that defines a bore 216 extending into the cavity 106 substantially co-axial with the body 102. The tube 208 differs from the tube 108 in that the slots 219 extending along the length of the tube 208 are located wholly within the tube 208, that is, between the inner 214 and outer 210 surfaces of the tube 208. Where the tube 208 is a single piece, these slots 219 may be formed by machining, during extrusion of the tube 208 or by any other suitable technique. Alternatively, the tube 208 may be formed in two parts, that is, an inner and an outer part, with the axially extending slots 219 being defined between the outer surface of the inner part and the inner surface of the outer part. For example grooves can be machined on the outer surface of the inner part (similar to the first embodiment), with the outer part being in the form of a sleeve located over the inner part to close the grooves and form the slots 219.

In comparison to the first embodiment, the second embodiment provides improved cooling as the outer surface 210 of the tube 208 is fully in contact with the wall 112 of the cavity 106; in the first embodiment, part of the outer surface 110 of the tube 108 is machined to form grooves 118 so that there is less surface area in direct contact with the body 102 to conduct heat from the body 102.

Figure 4A:
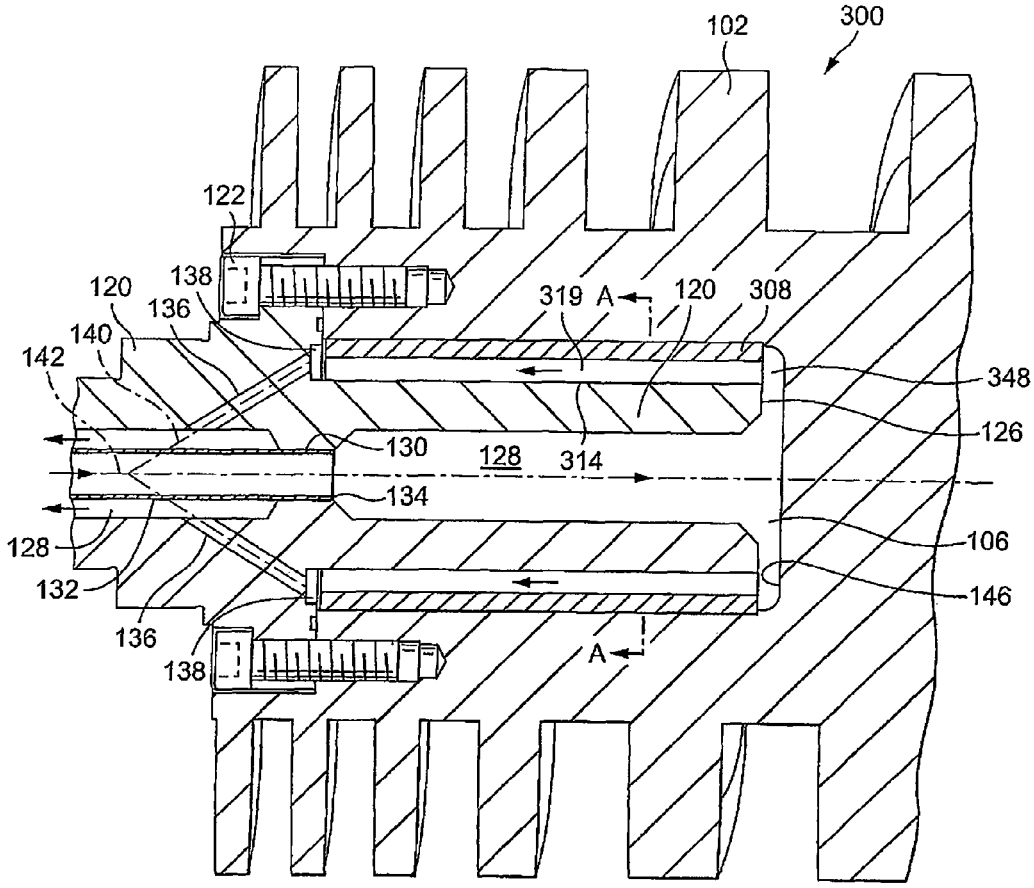
FIG. 4(*a*) is a cross-section through part of a third embodiment of a rotor of a screw pump, and FIG. 4(*b*) is a section along line A-A of FIG. 4(*a*)
Figure 4B:
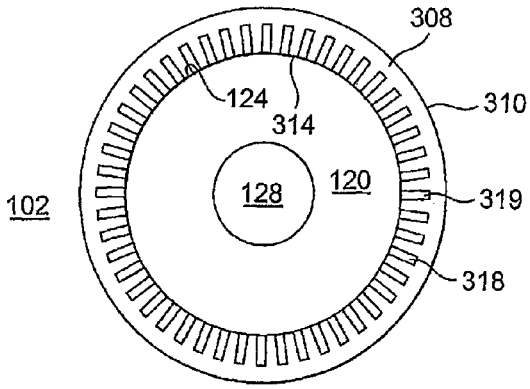

FIG. 4 illustrates part of a third embodiment of a rotor 300 of a screw pump; again, features identical to those of the first embodiment shown in FIG. 2 have been given the same reference numerals. In this third embodiment, the end 126 of the shaft 120 has been extended in comparison to the first embodiment so that, when the shaft 120 is attached to the body 102, a narrow radial clearance 348 is defined between the end 126 of the shaft 120 and the end wall 146 of the cavity 106. The longitudinal bore 128 is similarly extended in comparison to the first embodiment so that the longitudinal bore 128 extends from the reduced diameter portion 130 to the end 126 of the shaft 120.

The tube 308 of the third embodiment is located over the cylindrical wall 124 of the end 126 of the shaft 120, and again forms an interference fit with the cylindrical wall 112 of the cavity 106. In this embodiment, the inner surface 314 of the tube 308 is machined, for example, using wire erosion, to form grooves 318 which, when the tube 308 is fitted over the end 126 of shaft 120, define with the wall 124 of the shaft 120 axially extending slots 319. Alternatively, slots 319 may be formed using an extrusion technique.

In this third embodiment, both the tube 308 and the shaft 120 define the guide for guiding the flow of coolant within the cavity 106. In use, the stream of coolant received by and flowing through the bore 142 of the coolant supply tube 132 enters the longitudinal bore 128 from the end 134 of the coolant supply tube 132. The coolant flows through the bore 128, of the shaft 120, flows radially outwards between the end 126 of the shaft 120 and the end wall 146 of the cavity 106, and then enters the slots 319 defined between the tube 308 and the shaft 120. The coolant flows through the slots 319 in a direction opposite to the direction of the coolant flow through the bore 128 into the annular recess 138. The passage of the coolant from the annular recess 138 then follows the same path as that of the coolant from the annular recess 138 of the first embodiment.

As the outer surface 310 of the tube 308 is fully in contact with the wall 112 of the cavity 106, the third embodiment can provide similar improvements in the cooling of the rotor 300 as the second embodiment.

The rotor 100, 200, 300 of any of the first to third embodiments may form part of a double-ended screw pump, as described in our earlier International patent application no. WO 2004/036049, the contents of which are incorporated herein by reference. In such a pump, gas enters the pump at a centrally located inlet and forms two streams that are conveyed through the pump in opposite directions towards respective outlets provided at the ends of the rotors. In this case, the cooling arrangement shown in any of FIGS. 2 to 4 may be provided at each end of the rotor.

Whilst in the first to third embodiments the tube is in contact with the body of the rotor, it has been found that similar advantages can be provided where there is a narrow gap, typically less than 0.1 mm, between the outer surface of the tube and the body of the rotor, with the shaft forming an interference fit with the bore of the tube. The close proximity of the tube to the body has been found to not restrict unduly the transfer of heat from the body to the tube, and can simplify construction of the pump. Depending on the size of the gap, the tube may thermally expand during use of the pump such that the outer wall of the tube contacts the body of the rotor.

Figure 5:
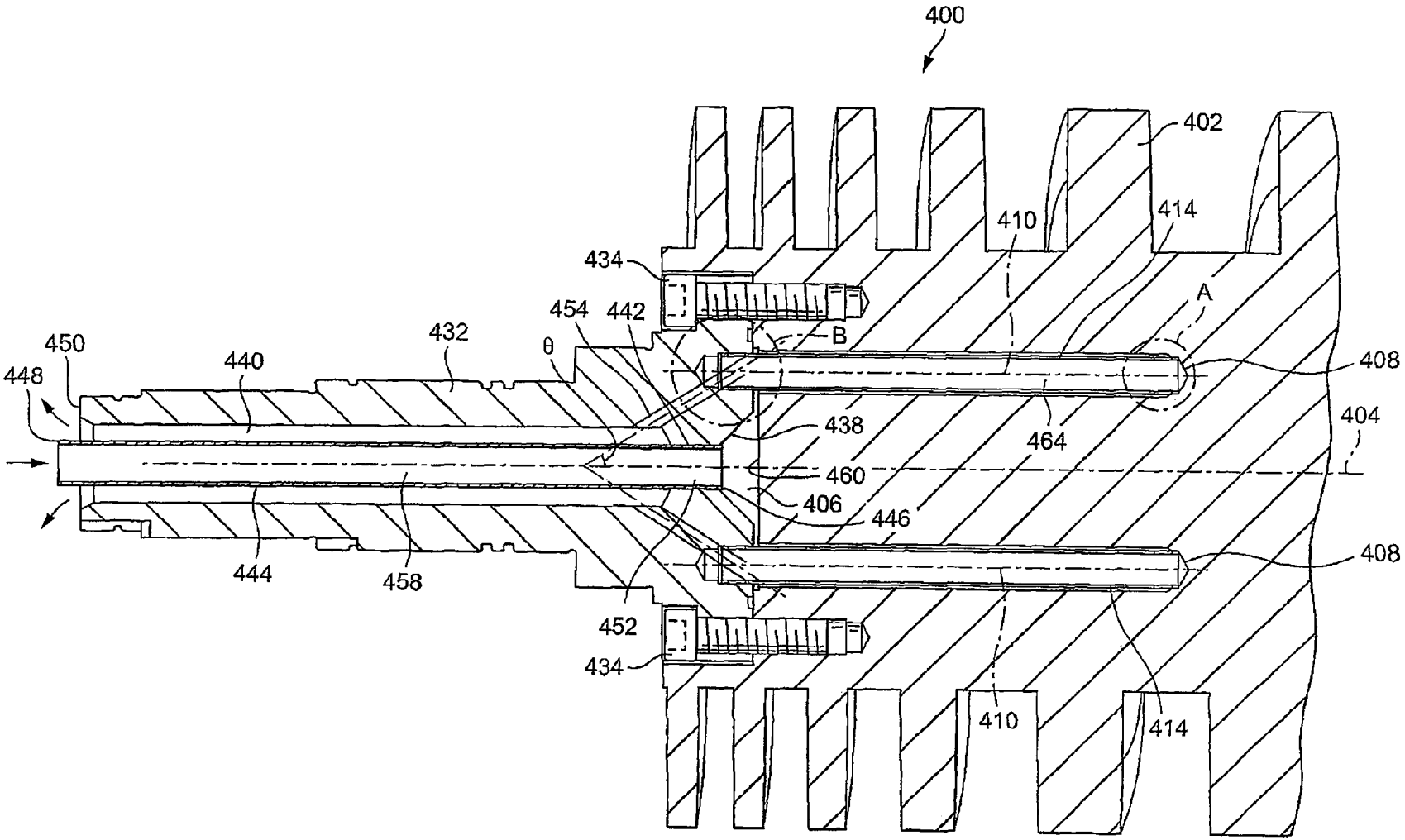
FIG. 5 is a cross-section through part of another rotor.

FIG. 5 illustrates part of a rotor 400 of a screw pump. The rotor 400 comprises a threaded body 402 having a longitudinal axis 404. A first cavity 406 is formed in the body 402, the first cavity 406 being substantially co-axial with the body 402. An array of second cavities 408 are also formed in the body 402, for example, by machining an array of bores into the body, the second cavities 408 being in fluid communication with the first cavity 406. Each of the second cavities 408 extends axially into the body 402 substantially parallel to the longitudinal axis 404 of the body, each second cavity 408 extending partially into the body 402. The longitudinal axis 410 of each of the second cavities is spaced from the longitudinal axis 404 of the body 402. In a preferred embodiment the rotor 400 includes ten second cavities 408, each second cavity 408 being equidistantly spaced from the longitudinal axis 404 of the body 402 and equiangularly spaced from the immediately adjacent second cavities 408. The number of second cavities 408, and their arrangement about the longitudinal axis 404 of the body 402 are not limited to this particular configuration; any suitable number and arrangement of second cavities 408 may be provided to meet the cooling requirements of the rotor 400.

Figure 7:
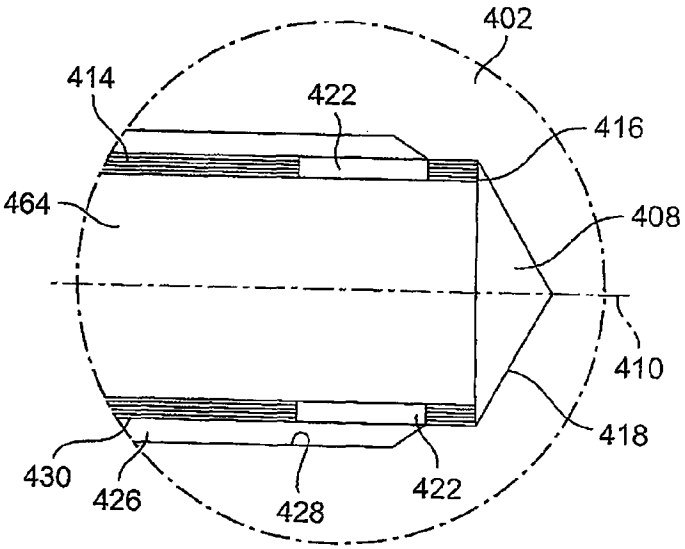
FIG. 7 is an enlarged cross-sectional view of the area indicated at A in FIG. 5.
Figure 6:
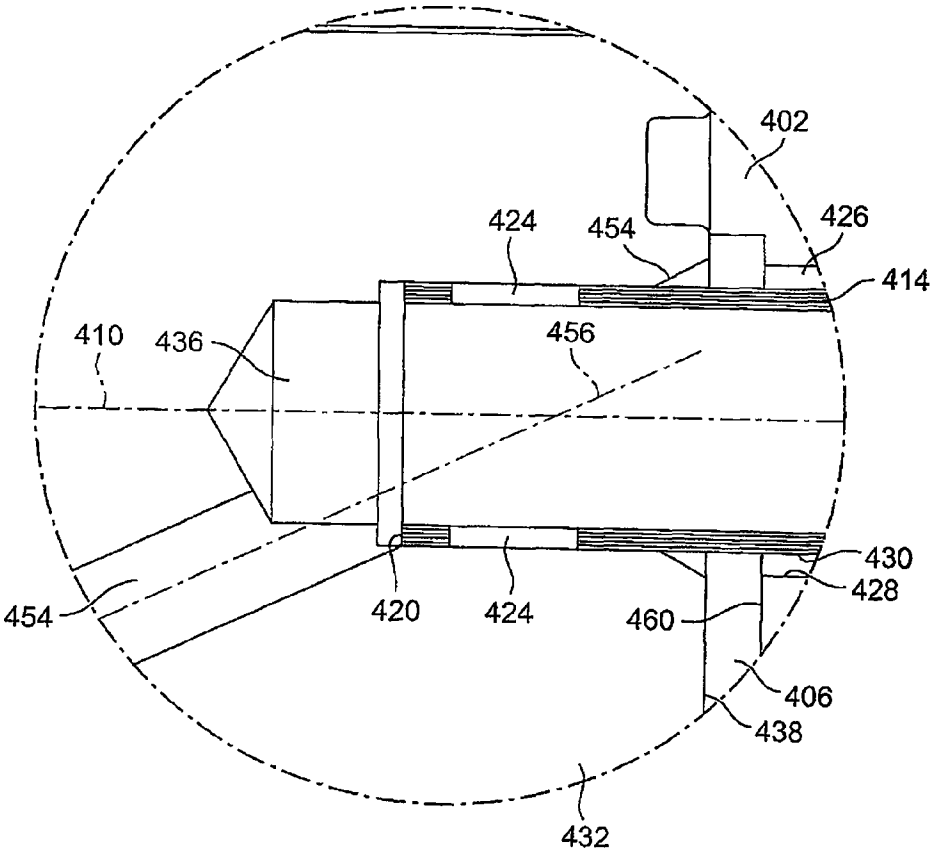
FIG. 6 is an enlarged cross-sectional view of the area indicated at B in FIG. 5.

A tube 414 is located within each second cavity 408. With reference also to FIGS. 6 and 7, in this embodiment a first end 416 of each tube 414 engages the end 418 of its respective second cavity 408, with the second end 420 of the tube 414 standing proud from the second cavity 408. A plurality of radial bores 422 are formed proximate the first end 416 of each tube 414 (as shown in FIG. 7, similar radial bores 424 are also formed proximate the second end 420 of the tube 414 to conveniently allow either the first end 418 or the second end 420 of the tube 414 to be inserted into the second cavity 408, although in use these additional radial bores 424 are redundant and therefore are not essential to provide). Each tube 414 has an outer diameter that is smaller than the bore of its respective second cavity 408 so as to define a narrow channel 426 between the cylindrical wall 428 of the second cavity 408 and the cylindrical outer surface 430 of the tube 414.

A shaft 432 is located within the first recess 406 and attached to the body 402 by means of bolts 434 or the like. As indicated in FIG. 5, the shaft 432 is co-axial with the body 402. The shaft 432 has a plurality of first bores 436 formed in the end 438 located within the first cavity 406, the first shaft bores 436 being co-axial with the second bores 408 formed in the body 402 to enable the first shaft bores 436 to receive the ends 420 of the tubes 414.

The shaft 432 also includes a second, longitudinal bore 440 that passes along the entire length of the shaft 432 and is co-axial therewith. The longitudinal bore 440 has a constant diameter along the majority of the shaft 432, the diameter reducing towards the end 438 of the shaft to define a reduced-diameter section 442 of the longitudinal bore 440. A coolant supply tube 444 is located within the longitudinal bore 440. The coolant supply tube 444 has an outer diameter that is slightly less than that of the reduced-diameter section 442 of the longitudinal bore 440. The coolant supply tube 444 extends through the longitudinal bore 440 such that a first end 446 thereof extends into the first cavity 406 and a second end 448 thereof extends from the end 450 of the shaft 432. The second end 448 of the coolant supply tube 444 may be retained by any convenient means. To inhibit rotation of the coolant supply tube 444 within the longitudinal bore 440 with rotation of the rotor 400, a plain bearing 452 is provided between the reduced-diameter section 442 of the longitudinal bore 440 and the coolant supply tube 444.

The shaft 432 further includes a plurality of third bores 454, each extending between the longitudinal bore 440 and a respective first shaft bore 436. The longitudinal axis 456 of each third shaft bore 454 is at an acute angle θ to the longitudinal axis 404 of the rotor 400. In this example, θ=300, although any convenient value for θ may be chosen.

In use, a stream of coolant, for example a coolant oil, is supplied from a source thereof to the second end 448 of the coolant supply tube 444. The source may be conveniently provided by an oil reservoir located external to the stator of the pump in which the rotor is housed. The coolant flows through the bore 458 of the coolant supply tube 444 into the first cavity 406, from which the coolant flows radially outwards between the end 438 of the shaft 432 and the end wall 460 of the first cavity 406 and enters the channels 426 defined between the tubes 414 and the second bores 408 of the rotor. The width of the channel 426 is preferably such that the flow speed of the coolant within the channel 426 is as high as possible, thereby enhancing the cooling function of the coolant. The coolant flows along the length of each channel 426, passes inwardly through the radial bores 422, and flows back towards the shaft 432 through the bores 464 of the tubes 414, that is, in a direction opposite to the direction of the coolant flow through the channels 426. From the second ends 420 of the tubes 414, the coolant enters the first shaft bores 436, from which it is conveyed into the bore 440 of the shaft 432 via the third shaft bores 454. The coolant passes within the bore 440 along the outside of the coolant supply tube 444 and is exhaust from the end 450 of the shaft back into the oil reservoir, from which the coolant may be pumped back to the end 448 of the shaft 432 via a suitable heat exchange mechanism.

Figure 1:
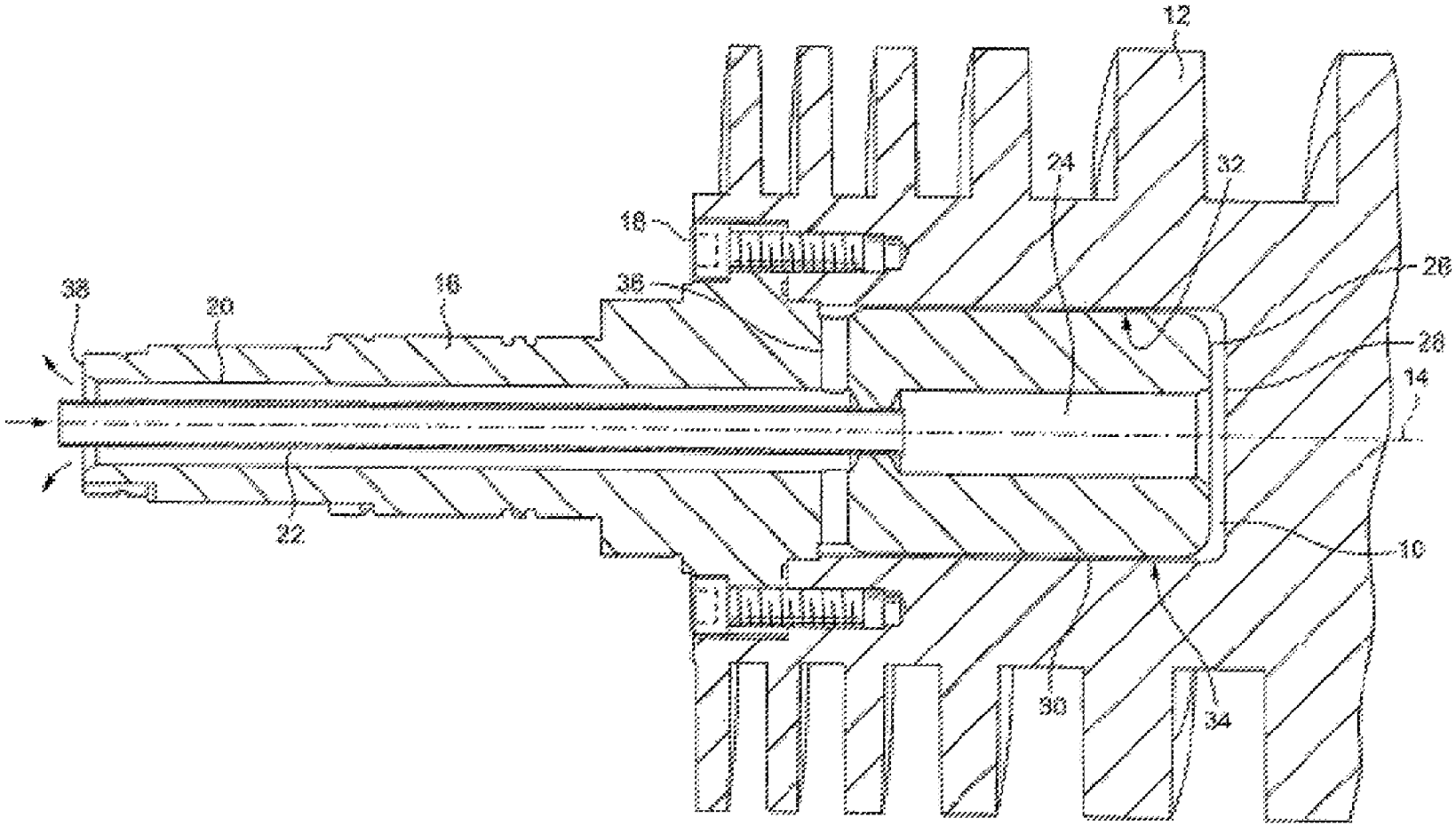
FIG. 1 (Prior Art)
FIG. 1 is a cross-section through part of a known rotor of a screw pump.

By providing an arrangement in which an array of channels 426 are provided for conveying a coolant within and in contact with the body 402 of the rotor 400, the contact surface area between the coolant and the body 402 is significantly increased in comparison to an arrangement as shown in FIG. 1 in which a single such channel is provided. This enhances the cooling of the rotor 400 and thus enables the cold radial clearance between the rotor and the stator to be reduced, thereby providing an improvement to the pumping efficiency.

The rotor 400 may form part of a double-ended screw pump, as described in our earlier International patent application no. WO 2004/036049, the contents of which are incorporated herein by reference.

I claim:

1. A rotor for a vacuum pump, the rotor comprising a threaded body, a cavity extending axially into the body, means for supplying a coolant to the cavity, means for discharging coolant from the cavity, and means located within the cavity for guiding a coolant flow between the supply means and the discharge means, wherein the guiding means has an inner surface defining a bore and an outer surface located adjacent the body to enable heat to be transferred thereto from the body, and defines a plurality of slots extending along the guiding means, the slots being radially spaced from and in fluid communication with the bore, wherein the supply means comprises a supply tube located within a shaft attached to the body for supplying coolant to the guiding means, wherein the discharge means comprises a discharge line located within the shaft and means for conveying coolant from the slots to the discharge line, wherein the conveying means further comprises a plurality of second discharge lines located within the shaft and extending from an annular channel for receiving coolant from said slots to the discharge line.

2. The rotor according to claim 1 wherein the guiding means is formed from a different material than the material of the threaded body.

3. The rotor according to claim 1 wherein at least part of the guiding means is formed from a material having a thermal conductivity that is equal to or greater than the thermal conductivity of the material of the threaded body.

4. The rotor according to claim 1 wherein at least a portion of the guiding means comprises a metallic material.

5. The rotor according to claim 1 wherein the guiding means comprises a metal selected from the group consisting of aluminium, copper, any alloy of the aluminium, and any alloy of the copper.

6. The rotor according to claim 1 wherein the guiding means comprises a tube located within the cavity.

7. The rotor according to claim 6 wherein the tube has a circular cross-section.

8. The rotor according to claim 6 wherein the guiding means comprises a shaft about which said tube is located.

9. The rotor according to claim 8 wherein the slots are located between the shaft and the tube.

10. The rotor according to claim 1 wherein the outer surface of the guiding means is profiled to define with the body the slots.

11. The rotor according to claim 1 wherein the slots are located between the inner and outer surfaces of the guiding means.

12. The rotor according to claim 1 wherein the supply tube is arranged to supply coolant to the bore of the guiding means.

13. The rotor according to claim 12 wherein the supply tube is substantially co-axial with the body.

14. The rotor according to claim 1 wherein a bearing is located between the supply tube and the shaft so as to inhibit rotation of the supply tube with the shaft.

15. The rotor according to claim 1 wherein the discharge line extends about the supply tube.

16. The rotor according to claim 1 wherein the guiding means is located adjacent the body so that, in use, the guiding means contacts the body.

17. The rotor according to claim 1 wherein the outer surface of the guiding means is spaced from the body by a distance less than 0.1 mm.

18. The rotor according to claim 1 wherein the outer surface of the guiding means is in contact with the body.

* * * * *